US005146621A

United States Patent [19]

Hadar et al.

[11] Patent Number: 5,146,621

[45] Date of Patent: Sep. 15, 1992

[54] SHOULDER PAD

[75] Inventors: Joseph C. Hadar, Ellisville; James R. Conley, Chesterfield, both of Mo.

[73] Assignee: Figgie International Inc., Willoughby, Ohio

[21] Appl. No.: 678,594

[22] Filed: Apr. 1, 1991

[51] Int. Cl.[5] ..... A41D 13/00

[52] U.S. Cl. ..... 2/2; 2/45; 2/268

[58] Field of Search ..... 2/2, 45, 268, 267, 44, 2/2.5

[56] References Cited

U.S. PATENT DOCUMENTS

| | | | |
|---|---|---|---|
| 1,516,644 | 11/1924 | Pierce | 2/2 |
| 1,685,825 | 10/1928 | Mullins | 2/2 |
| 2,013,794 | 9/1935 | Taylor | 2/2 |
| 2,266,886 | 12/1941 | McCoy | 2/2 |
| 2,316,055 | 4/1943 | Davey | 2/2.5 |
| 3,837,973 | 9/1974 | Asakura et al. | 156/470 |
| 3,991,420 | 11/1976 | Savarino | 2/2 |
| 3,999,928 | 12/1976 | Asakura et al. | 425/388 |
| 4,320,537 | 3/1982 | Mitchell | 2/2 |
| 4,370,754 | 2/1983 | Donzis | 2/2 |
| 4,481,679 | 11/1984 | Hayes | 2/2 |
| 4,715,066 | 12/1987 | Mitchell | 2/2 |
| 4,803,813 | 2/1989 | Fiterman | 52/199 |
| 4,870,706 | 10/1989 | Ketcham et al. | 2/2 |
| 4,985,931 | 1/1991 | Wingo, Jr. | 2/2 |

FOREIGN PATENT DOCUMENTS

| | | | |
|---|---|---|---|
| 124411 | 6/1947 | Australia | 2/2 |
| 0351147 | 1/1990 | European Pat. Off. | 2/247 |

*Primary Examiner*—Werner H. Schroeder
*Assistant Examiner*—Amy Brooke Vanatta
*Attorney, Agent, or Firm*—Senniger, Powers, Leavitt & Roedel

[57] ABSTRACT

A shoulder pad comprising a left-hand member which fits over the left shoulder and a right-hand member which fits over the right shoulder. Each of the members is of generally inverted U-shape as viewed from the side and has a chestplate portion, a backplate portion and an arch connecting the plate portions, the arches being laterally spaced to provide an opening for the neck of the wearer. Each of the members is fabricated from lightweight synthetic resin sheet material having a corrugated central layer formed with parallel corrugations, and a pair of generally parallel outer layers forming opposite exterior surfaces of the sheet material. The corrugations are resiliently deformable upon application of an impact load to the sheet material to attenuate the shock of the impact load on the wearer.

7 Claims, 4 Drawing Sheets

SHOULDER PAD

BACKGROUND OF THE INVENTION

This invention relates generally to athletic equipment and, more particularly, to a shoulder pad to be worn by athletes such as football and hockey players.

Over the years the design of shoulder pads has changed to provide greater protection for athletes. An effort has also been made to make these pads as lightweight as possible to reduce the burden and restrictions on the athlete. Nevertheless, there is a continuing demand for lighter shoulder pads which provide even greater protection.

SUMMARY OF THE INVENTION

Among the several objects of this invention may be noted the provision of an improved shoulder pad which is lighter in weight than conventional shoulder pads but which is durable and constructed to absorb blows and attenuate shock more effectively than shoulder pads of conventional design; and the provision of such a shoulder pad which is economical to manufacture.

Generally, a shoulder pad of this invention comprises a left-hand member adapted to fit over the left shoulder and a right-hand member adapted to fit over the right shoulder. Each of the members is of generally inverted U-shape as viewed from the side and has a chestplate portion, a backplate portion and an arch connecting the plate portions, the arches being laterally spaced to provide an opening for the neck of the wearer. Each of the members has padding secured to the inside thereof for protecting the wearer, and each of the members is fabricated from lightweight synthetic resin sheet material. The sheet material has a corrugated central layer formed with parallel corrugations, and a pair of generally parallel outer layers forming opposite exterior surfaces of the sheet material. The corrugations are resiliently deformable upon application of an impact load to the sheet material to attenuate the shock of the impact load on the wearer.

Other objects and features will be in part apparent and in part pointed out hereinafter.

BRIEF DESCRIPTION OF THE DRAWINGS

Corresponding parts are designated by corresponding reference numerals in the several views of the drawings.

DESCRIPTION OF THE PREFERRED EMBODIMENT

Figure 1:
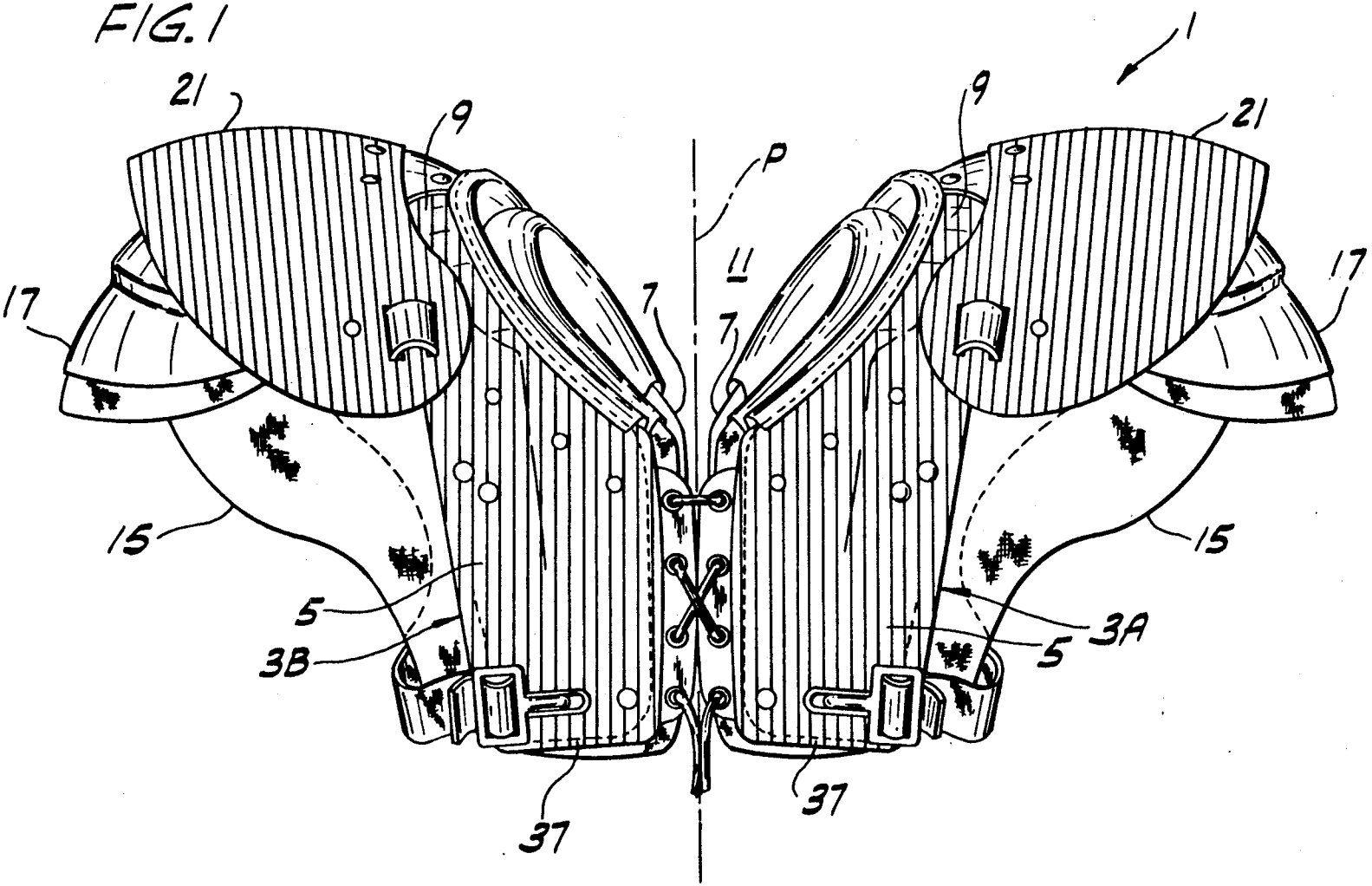
FIG. 1 is a perspective of a shoulder pad fabricated from corrugated sheet material in accordance with this invention.

Referring now to the drawings, and first to FIG. 1, there is generally indicated at 1 a shoulder pad of this invention fabricated from corrugated sheet material to be described hereinafter. As shown, the shoulder pad is generally of traditional construction, comprising a left-hand member generally designated 3A adapted to fit over the left shoulder and a right-hand member generally designated 3B adapted to fit over the right shoulder. These members combine to form what may be referred to as the shell of the shoulder pad. As viewed from the side of the shoulder pad, each of these members 3A, 3B is of generally inverted U-shape, having a generally planar chestplate portion 5, a generally planar backplate portion 7 and a curved arch 9 connecting the plate portions 5, 7, the arches being laterally spaced to provide an opening 11 for the neck of the wearer. Each of the left-hand and right-hand members has padding 15 secured to an inside surface thereof for protecting the player. It will be understood in this regard that the shoulder pad may be used by football players, or hockey players, or other players requiring substantial shoulder protection. The shoulder pad further comprises a shoulder cap 17 hinged to each arch 9 for overlying the outer portion of a respective shoulder, and a shoulder flap 21 hinged to each arch and adapted to overlie a respective shoulder cap to provide additional protection for the outer portion of the player's shoulder therebelow.

Figure 2:
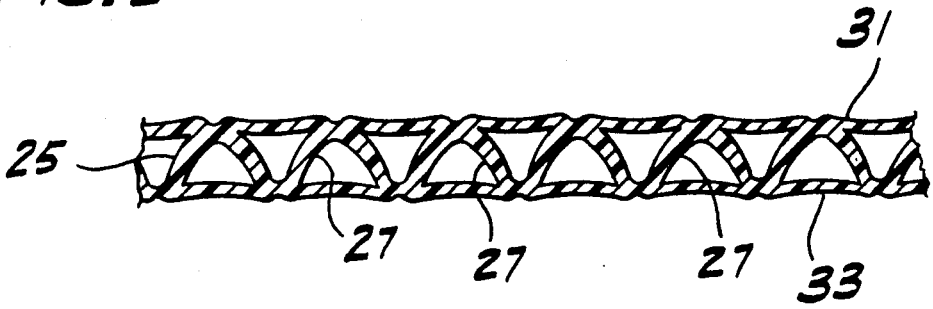
FIG. 2 is an enlarged section on line 2—2 of FIG. 1 showing the corrugated construction of the sheet material.
Figure 3:
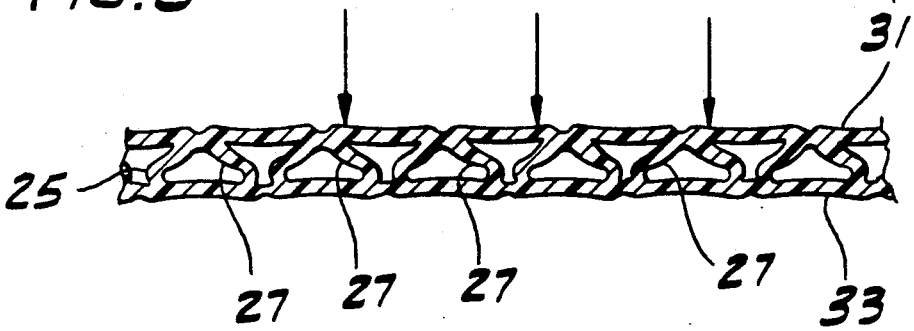
FIG. 3 is a view similar to FIG. 2 showing resilient deformation of the sheet material upon application of an impact load thereto.

In accordance with this invention, each of the left-hand and right-hand members 3A, **3*b*, of the shell, is fabricated from a lightweight sheet material of a suitable synthetic resin such as polyethylene, ABS (acrylanitrile butadiene styrene), polycarbonate or polypropylene. As best illustrated in FIG. 2, the sheet material has a corrugated central layer 25 formed with parallel corrugations 27, and a pair of generally parallel outer layers 31, 33 integrally formed with the central layer and forming opposite exterior surfaces of the sheet material. This corrugated construction is extremely lightweight to reduce the overall weight of the shoulder pad. Moreover, the corrugations 27 are resiliently deformable in a direction generally at right angles to the outer layers 31, 33 upon application of an impact load to the sheet material to more efficiently attenuate the shock of the impact load on the player (see FIG. 3**). Suitable corrugated sheet material of high density polyethylene useful in the fabrication of this shoulder pad is sold under the registered trademark "Corrulite" by United States Corrulite Corporation having a place of business in Glewiston, Fla.

The padding 15 is stitched as indicated at 37 to the chestplate and backplate portions 5, 7 of each member 3A, 3B, with the stitching extending all the way through the padding and through the central layer 25 and outer layers 31, 33 of the sheet material. The shoulder flaps 21 are also formed from the corrugated sheet material, although this is not essential to the practice of this invention.

For purposes of illustration, the corrugated sheet material may have an overall thickness in the range of 0.30 in. to 0.10 in., and preferably about 0.20 in., a modulus of elasticity in the range of 50,000 to 500,000 psi, and preferably about 100,000 psi, a hardness in the range of Shore D20-60 (per ASTM D2240) and preferably about Shore D50, a specific gravity in the range of 0.90 to 1.20, and preferably about 0.92 (per ASTM D792), and a tensile yield strength greater than about 1000 psi. As mentioned above, the synthetic resin material used may vary so long as it is sufficiently durable and has the above or comparable characteristics. The walls of the corrugations 27 should be at about a 30 degree angle relative to the outer layers 31, 33 of the sheet material, although this angle may also vary so long as the necessary shock attenuation is provided. It will also be noted in FIG. 1 that the corrugations 27 lie in spaced apart vertical planes generally parallel to the central vertical plane P of the shoulder pad running in front-to-back direction with respect to the shoulder pad. However, it will be understood that the corrugations 27 could run in a horizontal direction (generally perpendicular to plane P) without departing from the scope of this invention.

Figure 4:
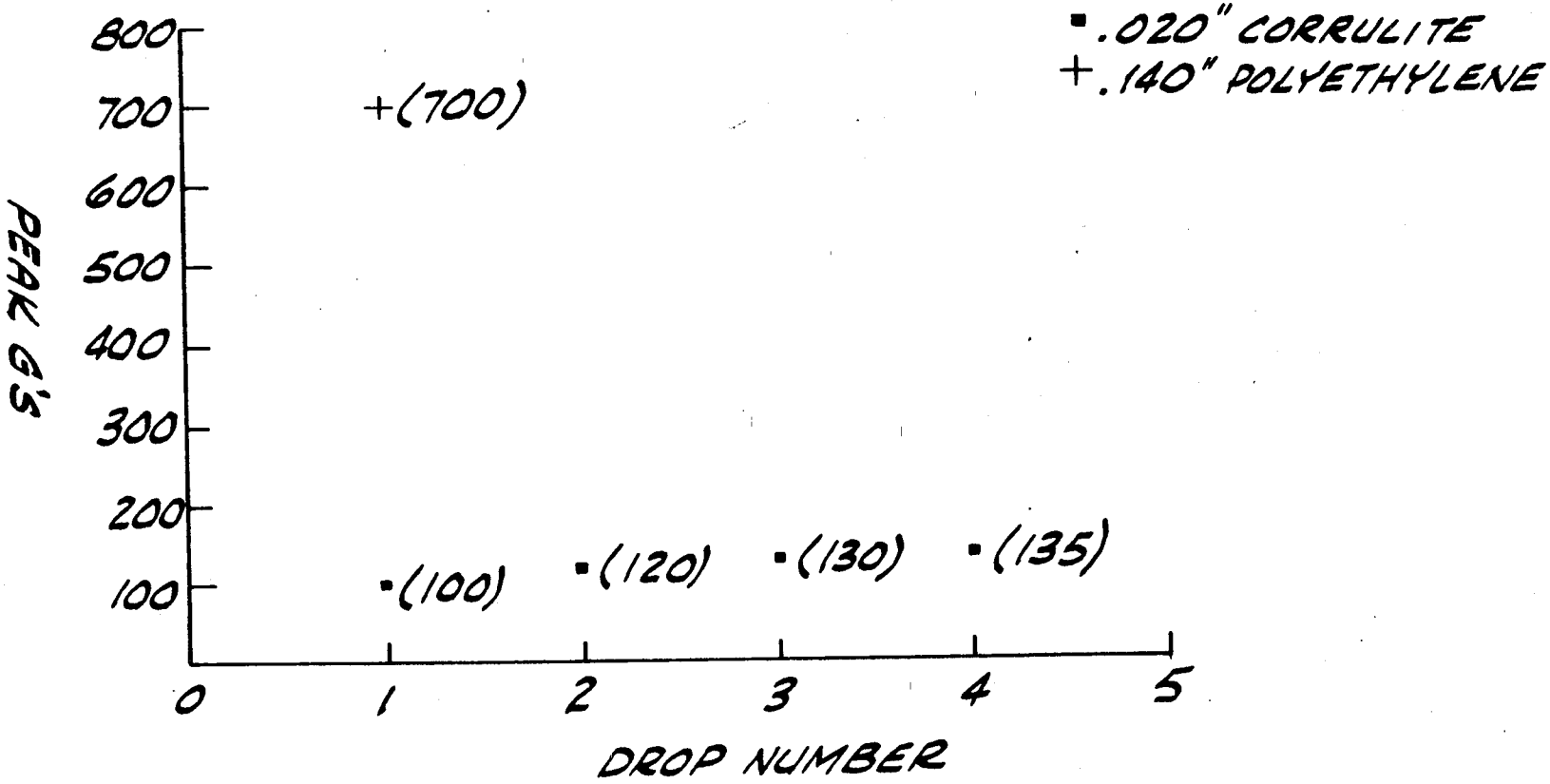
FIGS. 4 and 5 depict graphs showing the results of a series of tests conducted on the corrugated sheet material as compared to various non-corrugated sheet materials.

FIG. 4 is a graph depicting the results of a test in which a test head form weighing ten (10) lbs. and having a triaxial accelerometer at its center of gravity was dropped in guided free fall from a height of two (2) inches four times onto a 0.20 in.-thick sheet of corrugated "Corrulite" sheet material (each of the four drops being onto the same location) and once onto a 0.140 in.-thick standard flat (non-corrugated) sheet of polyethylene of the type used in a shoulder pad of conventional design. The sheets were supported by a rigid steel anvil, and the maximum deceleration of the head form was measured for each drop. The results of the test were then plotted on the graph, with the drop number being represented on the X-axis and the maximum deceleration being represented in "peak G's" on the Y-axis, each G being a unit of deceleration equal to 32 ft/sec$^2$Comparing the readings at the first drop for the corrugated and non-corrugated sheets, it will be observed that maximum deceleration associated with the "Corrulite" sheet is 100 peak G's compared to 700 peak G's for the standard (non-corrugated) polyethlene sheet, indicating that the shock attenuation of the "Corrulite" sheet is much greater than that of the standard sheet. Moreover, the shock attenuation capacity of the "Corrulite" sheet remained very high even after repeated drops, increasing only from 100 to 135 peak G's over four drops.

Figure 5:
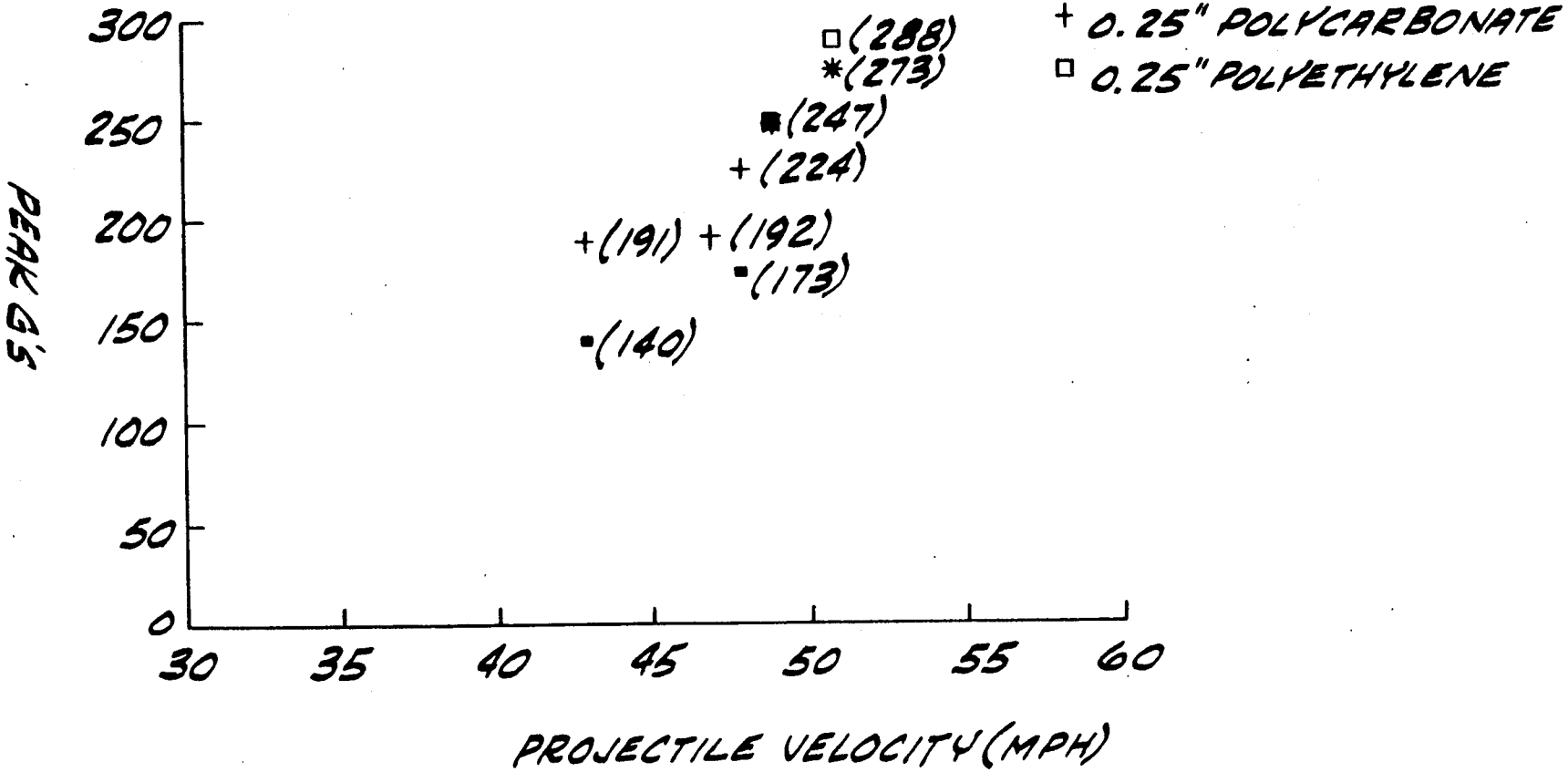

FIG. 5 is a graph similar to FIG. 4 depicting the results of a test in which a standard baseball was propelled by an air cannon against sheets of "Corrulite" plastic, ABS, polycarbonate, and polyethylene secured to a test head form weighing ten (10) lbs. and having a triaxial accelerometer at its center of gravity. The corrugated "Corrullite" sheet had a thickness of 0.20 in.; each of the other sheets, all of which were non-corrugated, had a thickness of 0.25 in. The velocity of the baseball prior to each impact was measured by an Oehler ballistic velocity measurement machine and recorded. Maximum acceleration of the head form was also measured for each impact. The results of these tests were then plotted on the graph of FIG. 5. It is apparent from these results that the corrugated "Corrulite" sheet outperformed the other materials by a wide margin in terms of attenuating the force of impact.

In the shoulder pad shown in the drawings, the left-hand and right-hand members 3A, 3B and the shoulder flaps 21 are shown as being fabricated from corrugated sheet material. However, it will be understood that more or less parts of the shoulder pad could be fabricated from corrugated sheet without departing from the scope of this invention.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

We claim:

1. A shoulder pad comprising a left-hand member adapted to fit over the left shoulder of a wearer and a right-hand member adapted to fit over the right shoulder of a wearer, each of said members being of generally inverted U-shaped as viewed from the side and having a chestplate portion, a backplate portion and an arch connecting the plate portions, said arches being laterally spaced to provide an opening for the neck of the wearer, said members combining to form a shoulder pad shell, each of said members having padding secured to an inside surface thereof for protecting the wearer, said members of the shell being fabricated from lightweight synthetic resin sheet material, said sheet material having a corrugated central layer formed with parallel corrugations, and a pair of generally parallel outer layers forming opposite exterior surfaces of the sheet material, said corrugations being resiliently deformable upon application of an impact load to said sheet material to attenuate the shock of said impact load on the wearer.

2. A shoulder pad as set forth in claim 1 wherein said synthetic resin material is polyethylene.

3. A shoulder pad as set forth in claim 1 wherein said shoulder pad has a central vertical plane extending in front-to-back direction with respect to the shoulder pad, and wherein said corrugations lie in spaced-apart vertical planes generally parallel to said central vertical plane.

4. A shoulder pad as set forth in claim 1 further comprising a pair of shoulder flaps mounted on said arches and adapted to overlie said shoulders, each flap also being fabricated from said lightweight synthetic resin material.

5. A shoulder pad as set forth in claim 1 wherein said corrugations are resiliently deformable in a direction generally at right angles to said outer layers.

6. A shoulder pad as set forth in claim 1 wherein said corrugated central layer is integrally formed with said outer layers.

7. A shoulder pad as set forth in claim 1 wherein said padding is stitched to said sheet material with the stitching extending through the padding and through the central and outer layers of the sheet material.

* * * * *